United States Patent [19]

Oehlerking

[11] 3,936,210

[45] Feb. 3, 1976

[54] CONCRETE FLOAT AND ACCESSORY THEREFOR

[76] Inventor: Erwin L. Oehlerking, 9798 Oak, Des Plaines, Ill. 60016

[22] Filed: Nov. 13, 1974

[21] Appl. No.: 523,214

[52] U.S. Cl. ..... 404/89; 404/97; 15/235.4

[51] Int. Cl.² ..... E01C 23/02

[58] Field of Search .... 404/97, 89; 15/105.5, 235.3, 15/235.4, 235.5, 235.6, 235.8

[56] References Cited

UNITED STATES PATENTS

| | | | |
|---|---|---|---|
| 842,770 | 1/1907 | Connelly | 404/97 X |
| 988,457 | 4/1911 | Classcock | 404/97 X |
| 1,273,060 | 7/1918 | Hoff | 404/97 |
| 1,296,325 | 3/1919 | Schuffenhauer | 15/105.5 |
| 1,673,941 | 6/1928 | Guarino | 15/235.6 |
| 3,090,066 | 5/1963 | Ferrell | 15/235.8 |

*Primary Examiner*—Nile C. Byers, Jr.

[57] ABSTRACT

A concrete finishing tool has a detachable accessory secured to float member of the tool, the accessory including an elongated concrete member extending in the direction of movement of the float member, and structure is employed for securing the elongated member at opposed edges of the float member.

6 Claims, 7 Drawing Figures

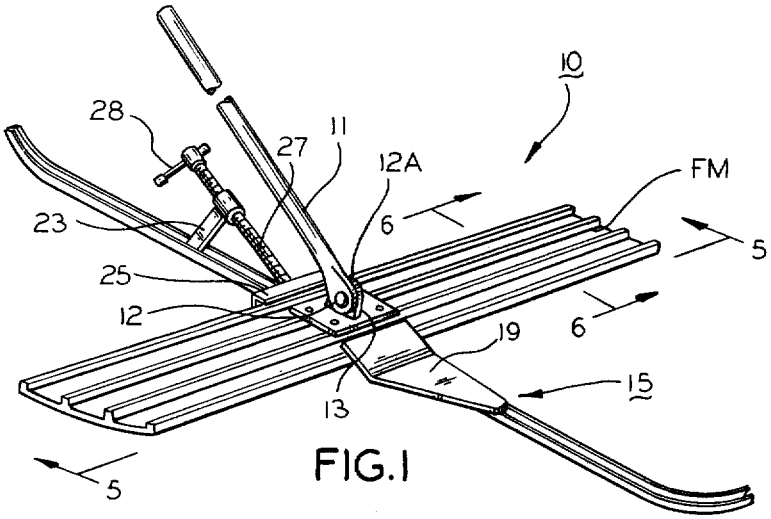
FIG.1
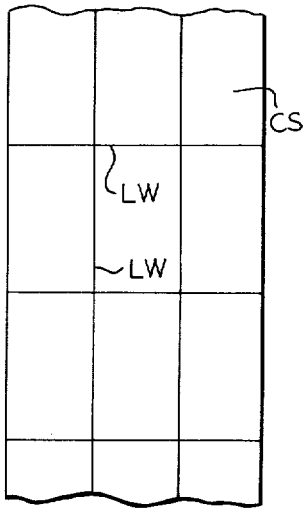
FIG.7
FIG.4
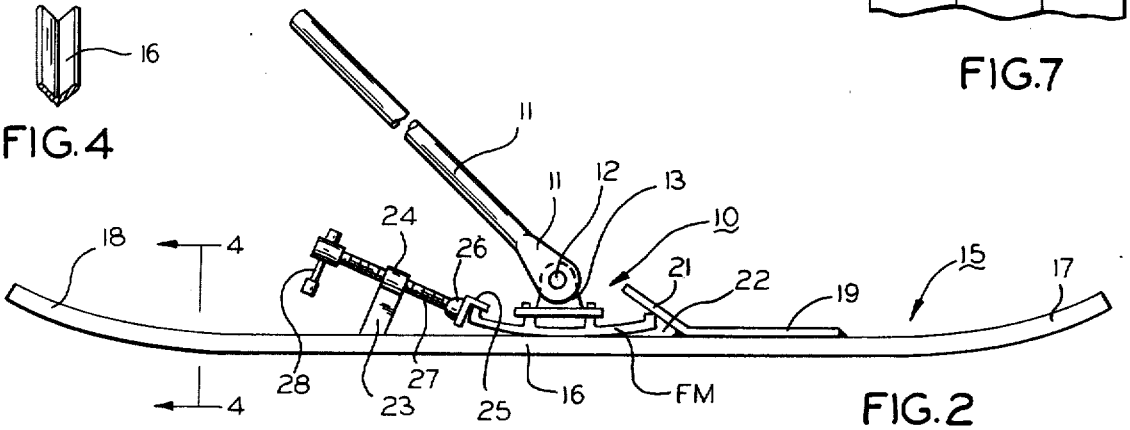
FIG.2
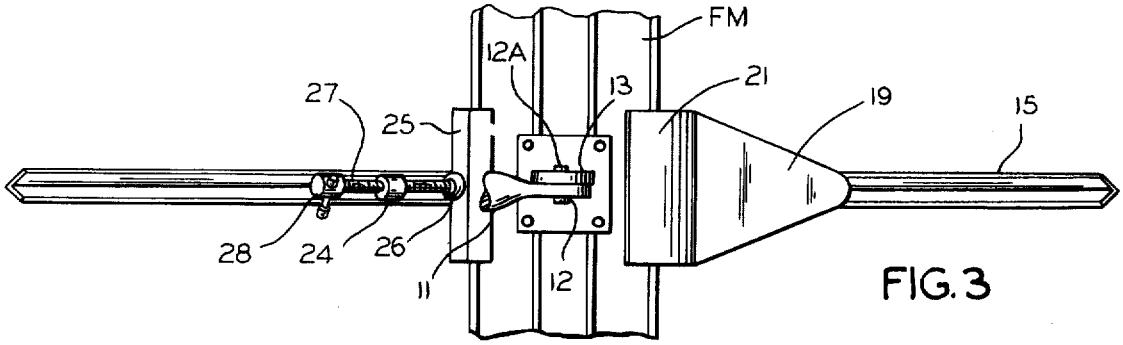
FIG.3
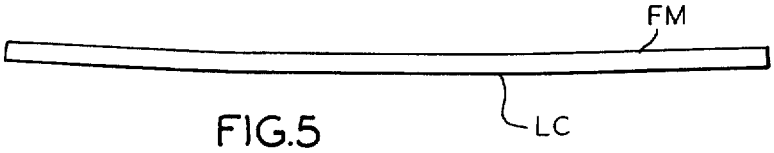
FIG.5
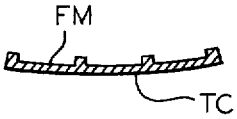
FIG.6

CONCRETE FLOAT AND ACCESSORY THEREFOR

BACKGROUND OF THE INVENTION

The structure according to the present invention finds particular use in the finishing of large areas such as Portland cement concrete driveways which are ordinarily provided with a fine brush finish. In order to provide joints of weakness in the finished slabs the concrete is allowed to set up to a condition where wooden planks may be laid thereon for support of a finisher who manipulates a jointing tool for such purpose. Such operations take an inordinate amount of time and are extremely costly.

According to the present invention the surface of the concrete is finished by a long handled float, known in the trade as a bull float, and after being properly finished the float has affixed thereto a rigid elongated member which, when the float is manipulated, describes a line of weakness in the yet unset concrete. The member is part of an accessory which can be readily secured to or removed from the float.

THE DRAWING

FIG. 1 is an isometric view showing an improved concrete float according to the present invention;

FIG. 2 is a side view thereof;

FIG. 3 is a top view thereof; FIG. 4 is a section taken along the line 4—4 of FIG. 2 looking in the direction of the arrows;

FIG. 5 is an elevational view looking at the long edge of the float;

FIG. 6 is a section taken along the line 6—6 of FIG. 1 looking in the direction of the arrows; and FIG. 7 is a plan view of a concrete slab which has been finished by the float of FIG.

The improved float is denoted by the reference number 10 and consists of a float member FM manipulated in a to and fro direction over a freshly laid and screeded concrete surface CS seen in FIG. 7. Float member FM is mounted at the lower end of a long handle 11, it being pivotally connected at 12, 12A to an abutment 13 secured in any convenient fashion to the upper surface of float member FM. As seen in FIGS. 5 and 6 float member FM is curved slightly along a longitudinal axis as denoted by LC and along a transverse axis as denoted by TC for a purpose as is well known.

The use of the structure thus far described is well known, being for compacting and smoothing of the freshly laid and screeded concrete surface. Desirably, and before the surface has completely set, the surface should be provided with intersecting lines of weakness LW for controlling the direction of cracking in the cured slab.

Accordingly, the float 10 is provided with accessory 15 capable of being detachably secured to float 10 and capable of scoring or grooving the surface CS with lines of weakness LW.

Accessory 15 includes a rigid elongated surface engaging emember 16 bowed upward at its forward end as at 17 and at its rearward end 18. Member 16 is preferably formed with a V transverse cross section as seen in FIG. 4.

Structure is provided for detachably securing accessory 15 to float member FM and a plate 19 extending in a horizontal plane is welded to member 16, plate 19 having an upward extending plate 21 integral therewith to define with member 16 a jaw 22 engaging the forward edge of float member FM. An adjustable jaw is adapted to engage the rear edge of float member FM and is connected by a swivel joint 26 to an adjusting screw 27 threaded into an eye 24 at the upper end of an arm 23 secured to the upper side of member 16 and extending upward therefrom. A handle 28 at the end of screw 27 is turned to exert pressure against jaw 25 to hold float member FM between jaws 25 and 22.

I claim:

1. A concrete finishing tool comprising a. a float member having an elongated element secured thereto for manipulating said float member to and fro in compacting and finishing the surface of a concreted area;

b. means secured to said float member after the same has completed the compacting and finishing operations for describing lines of weakness in the concrete surface for controlling the direction of cracks formed in the concreted area upon subsequent use thereof, said means comprising:

c. a rigid elongated surface engaging member deforming the surface of said concreted area before the curing of same;

1. said member having a length which is much greater than the width of said float member and having upturned ends for causing said member to ride smoothly on said surface in deforming the same;

d. means for detachably mounting said member to a side of said float member comprising an element bearing along one edge of said float member and a second element bearing along an opposed edge of said float member;

e. means extending between said elongated member and said second element for exerting pressure against said second element to hold said float member between both of said elements with said elongated member held in position with reference to said float member.

2. A finishing tool according to claim 1 wherein said elongated member has a V cross-section transversely thereof.

3. A finishing tool according to claim 1 wherein said last named means includes an adjustable screw.

4. An accessory for a concrete finishing tool of the type comprising a float member adapted to be moved to and fro over a concrete surface, said accessory forming lines of weakness in the concrete surface for controlling the direction of cracks in the cured concrete and comprising:

a. a rigid elongated surface engaging member for deforming the surface of said concrete and extending in a direction corresponding to the direction of movement of said float member;

1. said surface engaging member having a length which is much greater than the width of said float member and extending in a forward and rearward direction, and 2. having upturned ends for causing said surface engaging member to move smoothly over said surface;

b. means for securing said member to an edge of said float member comprising a jaw secured to said surface engaging member and in detachable engagement with an edge of said float member;

c. a movable jaw secured to said elongated member and in detachable engagement with an opposite edge of said float member;

d. and means for urging said movable jaw against said opposite edge to hold said accessory in place to said float member.

5. An accessory according to claim 4 wherein said surface engaging member has a transverse section in the form of a V.

6. An accessory according to claim 4 wherein said last named means includes an adjustable screw.

* * * * *